US006623135B2

(12) United States Patent
Moss

(10) Patent No.: US 6,623,135 B2
(45) Date of Patent: Sep. 23, 2003

(54) WRITING INSTRUMENT FOR PERSONS HAVING HYPOTONIA AND METHOD OF USE THEREOF

(76) Inventor: Jason L. Moss, 14 Parkside Dr., Great Neck, NY (US) 11021

( * ) Notice: Subject to any disclaimer, the term of this patent is extended or adjusted under 35 U.S.C. 154(b) by 25 days.

(21) Appl. No.: 10/061,677

(22) Filed: Nov. 7, 2001

(65) Prior Publication Data

US 2003/0147260 A1 Aug. 7, 2003

(51) Int. Cl.[7] ..... B43K 29/10

(52) U.S. Cl. ..... 362/118; 362/184; 362/204; 362/205; 362/230; 362/251; 362/394; 362/811

(58) Field of Search ..... 362/118, 204, 362/205, 811, 230, 231, 184, 234, 251, 394

(56) References Cited

U.S. PATENT DOCUMENTS

| | | | | |
|---|---|---|---|---|
| 4,475,240 A | * | 10/1984 | Brogardh et al. | 382/314 |
| 5,736,980 A | * | 4/1998 | Iguchi et al. | 345/179 |
| 6,099,185 A | | 8/2000 | Huang et al. | 401/195 |
| 6,106,132 A | | 8/2000 | Chen | 362/118 |

* cited by examiner

*Primary Examiner*—Sandra O'Shea
*Assistant Examiner*—Bertrand Zeade
(74) *Attorney, Agent, or Firm*—Goodwin Procter LLP

(57) ABSTRACT

An illuminating writing instrument useful for persons afflicted with hypotonia comprises:

(a) a housing having a lower end and an upper end;

(b) a writing core located within the housing, wherein the writing core has a first end which extends beyond the lower housing end and a second end;

(c) a head having a first head end which operatively interfaces the writing core second end, and a second head end;

(d) a force applying member which is operatively associated with the head; and (e) an electrical circuit which comprises in electrical connection:

(i) a power source, (ii) a first switch electrically operatively associated with the power source, (iii) a second switch which is operatively associated with the second head end, wherein the second switch is capable of generating a signal responsive to force being applied to the writing core first end, and (iv) a multicolor indicator operatively associated with the first and second switches and capable of receiving signals from the first and second switches and providing a distinct indication corresponding to each signal. A user having hypotonia may use the writing instrument to ensure that sufficient force is being applied by the user to permit writing.

12 Claims, 1 Drawing Sheet

WRITING INSTRUMENT FOR PERSONS HAVING HYPOTONIA AND METHOD OF USE THEREOF

BACKGROUND OF THE INVENTION

1. Field of the Invention

This invention relates to a writing instrument such as a pen or pencil which may be used by persons suffering from hypotonia (i.e., low or weak muscle tone) to enable such persons to more effectively write by indicating whether the writer is applying sufficient pressure to the writing instrument, as well as a method of using such a writing instrument. More particularly, the writing instrument of this invention employs a pressure sensing device and an indicator such as colored lights to notify the user whether sufficient pressure is being applied to the writing instrument to enable effective handwriting by the user.

2. Background Information

Hypotonia is a condition of low or weak muscle tone, and is a symptom of many diseases. For example, hypotonia may be a symptom of cerebral, spinal or muscular disease, as discussed in E. Mueller, "Fact Sheet on Hypotonia" (available at www.lightlink.com) (Aug. 1997).

Hypotonia is generally found in young children, although it may also be found in adults. Many problems have been associated with the disorder, including delayed motor development, shallow breathing, and little sustained speech. Hypotonia is sometimes also used as an indicator of specific syndromes in children; for example, hypotonia is symptomatic of children having an extra $21^{st}$ chromosome, which is the cause of Down syndrome.

Hypotonia causes developmental delays in many areas, including physical development. The major effect of hypotonia is the impairment of either fine or gross motor skills. Gross motor skills include crawling, walking, running, and jumping. These skills are age dependent. Fine motor skills include the ability to grasp a toy or finger, transfer a toy from one hand to another, point out an object, follow a toy or person with one's eyes, and use one's hands to feed oneself.

Children having low or weak muscle tone due to hypotonia are unable to move independently and have a hard time resisting the pull of gravity. A main concern of occupational therapists and parents is that a hypotonic child's fine motor skills may be affected due to the low or weak muscle tone of the wrists and hands. If this is the case, the child may experience difficulty using a writing instrument such as a pen or pencil to write. Because of the difficulty of controlling a writing instrument for a child having impaired fine motor skills, it is often difficult to decipher the child's handwriting even if the child is able to write.

Many different types of treatment and therapy have been developed to combat the problems created by hypotonia. One type of treatment for hypotonic children is early intervention and therapy. In therapy, depending on the individual case of hypotonia, a child may go through programs including early education, and speech, occupational and/or physical therapy. See N. Brown, "A Testing Time For Low Tone Kids" (available at www.lightlink.com) (December 1998).

For children whose fine motor skills are affected by hypotonia, there are few options available. In addition, the available methods do not focus on the child's actual fine motor skill problems, but rather, deal with the poor muscle tone that causes the lack of skill.

In view of the foregoing, it would be desirable to develop a writing instrument such as a pen or pencil which indicated to a hypotonic user such as a child whether sufficient pressure was being applied and maintained while the user was writing using the instrument. It is one object of this invention to provide such a writing instrument. It is another object of this invention to provide a method of using such a writing instrument. Other objects, features and advantages of this invention will be apparent to those skilled in the art from the following description.

SUMMARY OF THE INVENTION

An illuminating writing instrument useful for persons with hypotonia comprises:

(a) a housing having a lower end and an upper end;

(b) a writing core located within the housing, wherein the writing core has a first end which extends beyond the lower housing end and a second end;

(c) a head having a first head end which operatively interfaces the writing core second end, and a second head end;

(d) a force applying member which is operatively associated with the head; and (e) an electrical circuit which comprises in electrical connection:

(i) a power source, (ii) a first switch electrically operatively associated with the power source, (iii) a second switch which is operatively associated with the second head end, wherein the second switch is capable of generating a signal responsive to force being applied to the writing core first end, and (iv) a multicolor indicator electrically operatively associated with the first and second switches and capable of receiving signals from the first and second switches and providing a distinct indication corresponding to each signal.

A method of using an illuminating writing instrument to indicate the amount of force applied by a user in writing comprises:

(a) providing an illuminating writing instrument comprising:

(i) a housing having a lower end and an upper end, (ii) a writing core located within the housing, wherein the writing core has a first end which extends beyond the lower housing end and a second end, (iii) a head having a first head end which operatively interfaces the writing core second end, and a second head end, (iv) a force applying member which is operatively associated with the head, and (v) an electrical circuit which comprises in electrical connection:

(1) a power source, (2) a first switch operatively associated with the power source, (3) a second switch which is operatively associated with the second head end, wherein the second switch is capable of generating a signal responsive to force being applied to the writing core first end, and (4) a multicolor indicator operatively associated with the first and second switches and capable of receiving signals from the first and second switches and providing a distinct indication corresponding to each signal;

(b) providing power to the electrical circuit, thereby enabling the first switch to provide a first signal to the indicator, which causes the indicator to provide a first indication to the user; and (c) writing using the writing instrument by having the user transmit sufficient force upon a writing medium through the writing instrument such that the second switch provides a second signal to the indicator, which causes the indicator to provide a second indication to the user.

DETAILED DESCRIPTION OF THE INVENTION

This invention will be understood with reference to the accompanying drawings, which are not meant to limit the invention in any way.

Figure 1:
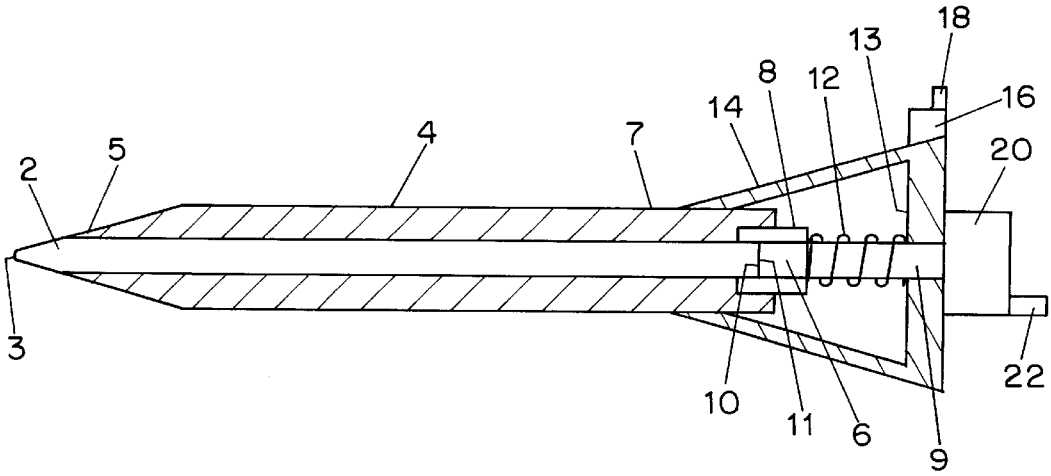
FIG. 1 is a perspective view of a writing instrument in accordance with one embodiment of this invention.

Referring now to FIG. 1, a writing core 2 which may be a graphite-containing pencil core (in the case of a mechanical pencil) or an ink-containing pen core (in the case of a pen) is contained within housing 4. A first end 3 of writing core 2 protrudes from a lower portion 5 of housing 4 and is used to contact a medium such as paper to deliver the appropriate material (e.g., graphite or ink) to the paper. A second end 10 of writing core 2 is operatively interfaced through cap 8 to a first end 11 of head 6 which may be the typical head or "plunger" portion of a pen or mechanical pencil used to engage or lock the writing core into a position for writing, as will be well understood by those skilled in the art. First end 11 of head portion 6 and second end 10 of writing core 2 are slidably engaged within cap 8, as shown.

A support 14 which may be a clamp, mount, or other type of suitable housing constructed from metal, plastic or other suitable material is affixed to upper portion 7 of housing 4. In one embodiment, support 14 is affixed via a clamp (not shown) to upper portion 7 of housing 4. Second end 9 of head 6 passes through an opening in support 14 (as shown). Second end 9 of head 6 operatively engages a double-pull, double-throw switch 20, which in turn is operatively associated with a multicolor indicator light 22 which may be a light emitting diode (LED). In a preferred embodiment, indicator light 22 is a dual color LED. Switch 20 and indicator light 22 are also operatively associated with a power source 16 and a main switch 18 and associated circuitry, as will be further described below. As shown in FIG. 1, all of switch 20, power source 16, switch 18 and indicator light 22 are directly or indirectly supported on support 14. All of switch 20, power source 16, switch 18 and indicator light 22 are electrically connected, as is also further described herein. A force applying member 12 (which may be a spring, as shown in FIG. 1) operatively interfaces and engages head portion 6, cap 8 and a surface 13 of support 14 as shown.

The operation of this invention in a preferred embodiment as depicted in FIG. 1 is as follows. Writing core 2 is operatively associated via second end 10 to first end 11 of head portion 6 through an opening in cap 8, and second end 9 of head 6 is in turn operatively engaged to switch 20. Spring 12 maintains an initial force on writing core 2 and head 6 and that force is transmitted via second end 9 to switch 20 using a force transducer or other means which may be integral to switch 20, as will be well understood by those skilled in the art. Power source 16 (which in this embodiment comprises two 1.5 volt A76 batteries connected in series) is controlled via switch 18, which in this embodiment includes associated circuitry which is a 100 ohm resistor (not shown). Power source 16 is electrically connected via wiring (not shown) through switch 18 to switch 20 (which in this embodiment is a No. 8225 switch available from C&K Co. (USA)). Switch 20 is electrically connected to indicator 22 (which in this embodiment is a dual color (e.g., red/green) LED).

Prior to the user beginning writing with the writing instrument, switch 18 is engaged to the "on" position to supply power to the circuit which includes switch 20 and LED 22. This causes LED 22 to light in a first color (say red), and indicates to the user that the writing instrument is ready for use. The user then contacts first end 3 of the writing instrument with a receiving medium such as paper which the user wishes to write upon. As the user applies increased force on the paper using the writing instrument in an attempt to write, such force is transmitted through writing core 2 to head portion 6, which moves towards surface 13 of support 14. The movement of head portion 6 compresses spring 12, which in turn imparts increased force to a force-receiving portion (e.g., a transducer) (not shown) operatively coupled and integral to switch 20. Spring 12 and the force-receiving portion of the switch are calibrated such that when the user is applying sufficient force to the writing instrument to achieve transfer of ink or graphite to the paper, the force will further compress spring 12 and this additional force will be transmitted to switch 20, which in turn will generate an electrical signal which causes LED 22 to change to a second color (say green). This color change indicates to the user that the correct amount of force is being applied to the writing instrument to permit writing. The user may continue to monitor the color of LED 22 while writing to insure that the correct amount of force is continuously being applied to the writing instrument by the user.

Figure 2:
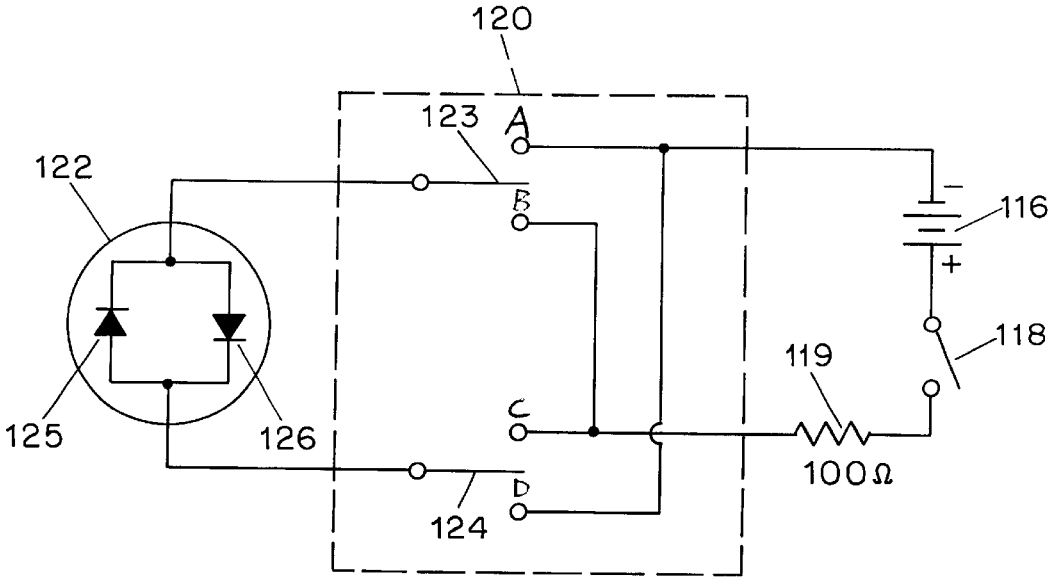
FIG. 2 is a circuit diagram of an electrical circuit used in the writing instrument of this invention.

FIG. 2 depicts a circuit diagram of an electrical circuit which may be employed with the writing instrument of this invention. In FIG. 2, power source 116 (e.g., two 1.5 volt A76 batteries connected in series) supplies power to the remainder of the circuit (described herein) via main switch 118 (shown in the open position). When switch 118 is closed, current is supplied to resistor 119 (which in this embodiment has a resistance of 100 ohms) to control current in the circuit. Current is then supplied to double-pull, double-throw switch 120 (shown in dashed lines), which is electrically operatively connected to dual color LED 122 as shown. Switch 120 contains two switches 123 and 124 as shown. When power is first supplied to the circuit by closing switch 118, current is supplied to first color LED 125 in dual color LED 122 through switch 120, which has switch 123 in default position A and switch 124 in default position C, thereby energizing a first (e.g., red) color LED 125 in dual color LED 122, and dual color LED 122 displays only the red color. When the user applies sufficient force to the writing instrument to achieve transfer of ink or graphite to the paper, the additional proportional force being applied causes switch 123 to move to position B and switch 124 to move to position D, thereby removing current from first color LED 125 and energizing second (e.g., green) color LED 126. Consequently, at this point dual color LED 122 displays only the green color. Thus, the user is made aware that the proper amount of force is being applied to the writing instrument, which now only displays the green color.

Although this invention has been illustrated and described herein with reference to certain preferred embodiments thereof, it will be understood that it is in no way limited to the details of these embodiments, but is capable of numerous modifications within the scope of the appended claims.

I claim:

1. An illuminating writing instrument comprising:

(a) a housing having a lower end and an upper end;

(b) a writing core located within the housing, wherein the writing core has a first end which extends beyond the lower housing end and a second end;

(c) a head having a first head end which operatively interfaces the writing core second end, and a second head end;

(d) a force applying member which is operatively associated with the head; and (e) an electrical circuit which comprises in electrical connection:

(i) a power source, (ii) a first switch electrically operatively associated with the power source, (iii) a second switch which is operatively associated with the second head end, wherein the second switch generates a signal responsive to force being applied to the writing core first end, and (iv) a dual color light emitting diode operatively associated with the first and second switches wherein the diode receives signals from the first and second switches and provides a distinct color corresponding to each signal.

2. The writing instrument of claim 1, in which the writing core is a graphite-containing pencil core.

3. The writing instrument of claim 1, in which the writing core is an ink-containing pen core.

4. The writing instrument of claim 1, in which the force applying member is a spring.

5. The writing instrument of claim 1, in which the power source is one or more batteries.

6. The writing instrument of claim 1, in which the second switch is a double-throw, double-pull switch.

7. A method of using an illuminating writing instrument to indicate the amount of force applied by a user in writing, comprising:

(a) providing an illuminating writing instrument comprising:

(i) a housing having a lower end and an upper end, (ii) a writing core located within the housing, wherein the writing core has a first end which extends beyond the lower housing end and a second end, (iii) a head having a first head end which operatively interfaces the writing core second end, and a second head end, (iv) a force applying member which is operatively associated with the head, and (v) an electrical circuit which comprises in electrical connection:

(1) a power source, (2) a first switch operatively associated with the power source, (3) a second switch which is operatively associated with the second head end, wherein the second switch generates a signal responsive to force being applied to the writing core first end, and (4) a dual color light emitting diode operatively associated with the first and second switches wherein the diode receives signals from the first and second switches and provides a distinct indication corresponding to each signal;

(b) providing power to the electrical circuit, thereby enabling the first switch to provide a first signal to the diode, which causes the diode to provide a first color to the user; and (c) writing using the writing instrument by having the user transmit sufficient force upon a writing medium through the writing instrument such that the second switch provides a second signal to the diode, which causes the diode to provide a second color to the user.

8. The writing instrument of claim 7, in which the writing core is a graphite-containing pencil core.

9. The writing instrument of claim 7, in which the writing core is an ink-containing pen core.

10. The writing instrument of claim 7, in which the force applying member is a spring.

11. The writing instrument of claim 7, in which the power source is one or more batteries.

12. The writing instrument of claim 7, in which the second switch is a double-pull, double-throw switch.

* * * * *